US010424445B2

(12) United States Patent
Kim et al.

(10) Patent No.: US 10,424,445 B2
(45) Date of Patent: Sep. 24, 2019

(54) ELECTRONIC DEVICE INCLUDING KEY BUTTON

(71) Applicant: Samsung Electronics Co., Ltd., Gyeonggi-do (KR)

(72) Inventors: Hoon-Jae Kim, Gyeongsangbuk-do (KR); Ki-Hwan Kwak, Gyeongsangbuk-do (KR); Kyung-Chul Seo, Gyeongsangbuk-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/958,117

(22) Filed: Apr. 20, 2018

(65) Prior Publication Data

US 2018/0261408 A1 Sep. 13, 2018

Related U.S. Application Data

(63) Continuation of application No. 14/916,054, filed as application No. PCT/KR2014/008286 on Sep. 3, 2014, now Pat. No. 9,953,775.

(30) Foreign Application Priority Data

Sep. 3, 2013 (KR) ..... 10-2013-0105767

(51) Int. Cl.
*H01H 13/70* (2006.01)
*H01H 13/06* (2006.01)
(Continued)

(52) U.S. Cl.
CPC ..... *H01H 13/063* (2013.01); *H01H 13/14* (2013.01); *H01H 13/86* (2013.01);
(Continued)

(58) Field of Classification Search
CPC ..... H01H 13/063; H01H 13/14; H01H 13/86; H01H 13/06; H01H 2223/002;
(Continued)

(56) References Cited

U.S. PATENT DOCUMENTS 2,690,481 A 9/1954 Courtney
4,417,113 A * 11/1983 Saito ..... G04B 37/106 200/302.2
(Continued)

FOREIGN PATENT DOCUMENTS

CN 102054612 A 5/2011
EP 2 804 320 A3 12/2014
(Continued)

OTHER PUBLICATIONS

Indian Search Report dated Jan. 19, 2019.
Korean Search Report dated Jul. 11, 2019.

*Primary Examiner* — Anthony R Jimenez
(74) *Attorney, Agent, or Firm* — Cha & Reiter, LLC.

(57) ABSTRACT

An electronic device, according to one embodiment of the present invention, can comprise: a housing which has an opening part penetrating through the inside and the outside of the electronic device and forms the outside of the electronic device; a key button inserted into the opening part so as to be movable; a sealing member which is disposed such that the sealing member slidably contacts the outer surface of the key button, and prevents communication between the inside and the outside of the electronic device through the inner surface of the opening part and the outer surface of the key button; and a push switch accommodated in the housing and pressed by an inward movement of the key button. Various other embodiments are possible.

20 Claims, 12 Drawing Sheets

(51) Int. Cl.
*H01H 13/86* (2006.01)
*H01H 13/14* (2006.01)

(52) U.S. Cl.
CPC ... *H01H 2223/002* (2013.01); *H01H 2223/04* (2013.01); *H01H 2225/028* (2013.01); *H01H 2227/024* (2013.01); *H01H 2235/008* (2013.01); *H01H 2235/01* (2013.01)

(58) Field of Classification Search
CPC ..... H01H 2223/04; H01H 2225/028; H01H 2227/024; H01H 2235/008; H01H 2235/01
USPC ..... 200/345
See application file for complete search history.

(56) References Cited

U.S. PATENT DOCUMENTS

| | | | |
|---|---|---|---|
| 8,519,286 | B1 | 8/2013 | Bloch |
| 2004/0203999 | A1 | 10/2004 | Liang et al. |
| 2011/0094328 | A1 | 4/2011 | Lee |
| 2011/0193903 | A1 | 8/2011 | Kim et al. |
| 2013/0105288 | A1 | 5/2013 | Derengowski et al. |
| 2014/0124343 | A1 | 5/2014 | Lee et al. |
| 2014/0340317 | A1 | 11/2014 | Rodzeveski et al. |

FOREIGN PATENT DOCUMENTS

| | | | |
|---|---|---|---|
| JP | 3034908 | U | 12/1996 |
| KR | 2000-0010990 | U | 6/2000 |
| KR | 10-2006-0075061 | A | 7/2006 |
| KR | 10-2011-0045629 | A | 5/2011 |
| KR | 10-2011-0092110 | A | 8/2011 |
| KR | 10-1107015 | B1 | 1/2012 |

* cited by examiner

ELECTRONIC DEVICE INCLUDING KEY BUTTON

CROSS REFERENCE TO RELATED APPLICATIONS

This application is a Continuation of U.S. patent application Ser. No. 14/916,054, filed on Mar. 2, 2016 which is a continuation of PCT/KR2014/008286, which was filed on Sep. 3, 2014, and claims a priority to Korean Patent Application No. 10-2013-0105767, which was filed on Sep. 3, 2013, the contents of which are incorporated herein by reference.

TECHNICAL FIELD

Various embodiments of the present disclosure relate to an electronic device that includes a key button that has a waterproof function.

BACKGROUND ART

At present, due to the development of the electronic communication industry, user devices (e.g., electronic devices, such as a cellular phone, an electronic scheduler, a personal composite terminal, and a laptop computer) have become necessities in modern society, and have become important means for transmitting rapidly changing information. Such user devices have made a user's task convenient through a GUI (Graphical User Interface) environment using a touch screen, and now provide various web-based multimedia.

A user device may be equipped with a key button that is disposed on a housing that forms an external appearance. For example, the user device may be equipped with a power key button so as to provide the user device with an ON/OFF function. Or, the user device may be equipped with a volume key so as to provide the user device with a volume function, and may be provided with various keys configured to receive a user input.

DETAILED DESCRIPTION OF THE INVENTION

Technical Problem

Various embodiments of the present disclosure are able to provide an electronic device that includes a key button configured to prevent foreign matter from infiltrating into the electronic device.

Technical Solution

According to various embodiments of the present disclosure, the electronic device may include: a housing including an opening formed therethrough to communicate between the inside and outside of the electronic device, and configured to form an external appearance of the electronic device; a key button movably inserted into the opening; a sealing member disposed to be in slidable contact with an outer face of the key button, and configured to block communication between the inside and outside of the electronic device 100 through a gap between an inner face of the opening and the outer face of the key button; and a push switch accommodated in the housing, and configured to be pressed by an inward movement of the key button.

Advantageous Effects

It is possible to improve the operating feeling of pushing of a key button while preventing foreign matter from infiltrating into an electronic device.

MODE FOR CARRYING OUT THE INVENTION

Figure 1:
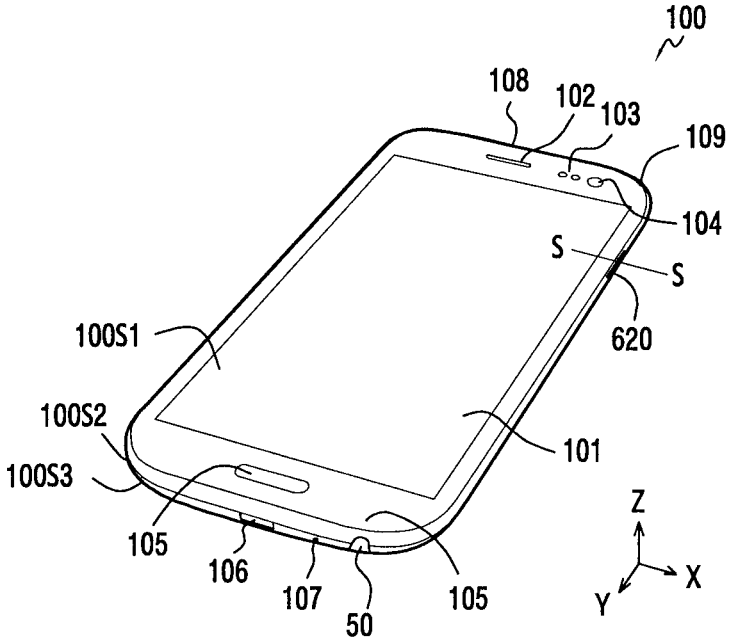
FIG. 1 is a perspective view illustrating an electronic device according to one embodiment of the present disclosure.

Hereinafter, various embodiments of the present disclosure will be described with reference to the accompanying drawings. Although various embodiments of the present disclosure are illustrated in the drawings and the relevant detailed descriptions are discussed in the present disclosure, the present disclosure may include various modifications and several embodiments. Accordingly, various embodiments of the present disclosure are not limited to the particular forms, and it should be understood that the present disclosure covers all modifications and changes, equivalents, and alternatives falling within the spirit and scope of the present disclosure. In describing the drawings, similar reference numerals are used to designate similar elements.

An electronic device according to various embodiments of the present disclosure may be a device with a communication function. For example, the electronic device may include at least one of a smart phone, a tablet Personal Computer (PC), a mobile phone, a video phone, an e-book reader, a desktop PC, a laptop PC, a netbook computer, a PDA, a Portable Multimedia Player (PMP), an MP3 player, a mobile medical device, a camera, a wearable device (for example, a Head-Mounted-Device (HMD) such as electronic glasses, electronic clothes, an electronic bracelet, an electronic necklace, an electronic appcessory, an electronic tattoo, and a smart watch.

According to some embodiments, the electronic device may be a smart home appliance with a communication function. The smart home appliance as an example of the electronic device may include at least one of a television, a Digital Video Disk (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™, a game console, an electronic dictionary, an electronic key, a camcorder, and an electronic picture frame.

According to some embodiments, the electronic device may include at least one of various types of medical devices (for example, Magnetic Resonance Angiography (MRA), Magnetic Resonance Imaging (MRI), Computed Tomography (CT), a scanning machine, ultrasonic wave device and the like), a navigation device, a Global Positioning System (GPS) receiver, an Event Data Recorder (EDR), a Flight Data Recorder (FDR), a car infotainment device, ship electronic equipment (for example, navigation equipment for a ship, a gyro compass and the like), avionics, and a security device.

According to some embodiments, an electronic device may include at least one of a part of furniture or a building/structure having a communication function, an electronic board, an electronic signature receiving device, a projector, and various types of measuring instruments (for example, a water meter, an electric meter, a gas meter, a radio wave meter, and the like). An electronic device according to various embodiments of the present disclosure may be a combination of one or more of above described various devices. Also, an electronic device according to various embodiments of the present disclosure is not limited to the above described devices.

FIG. 1 is a perspective view illustrating an electronic device according to one embodiment of the present disclosure. The electronic device 100 may include a top face 100S1, a side face 100S2, and a bottom face 100S3. The side face 100S2 may interconnect the top face 100S1 and the bottom face 100S3. Here, the top face 100S1, the side face 100S2, or the bottom face S3 may include a flat face or a curved face.

Referring to FIG. 1, the electronic device 100 may include a touch screen 101, a speaker 102, one or more sensors 103, a camera 104, one or more key buttons 105 and 620, an external port 106, a microphone 107, a jack 108, an antenna 109, or a stylus 50.

The touch screen 101 may be disposed on the top face 100S1. The touch screen 101 may display an image, and may receive a touch input. The touch screen 101 may include a window, a display, a touch panel, or a pen sensor (e.g., a digitizer).

The speaker 102 may output an electric signal as sound. According to one embodiment, the speaker 102 is disposed on the top face 100S1, but may be disposed on the side face 100S2 or the bottom surface 100S3 without being limited thereto.

The one or more sensors 103 may measure a physical quantity or may sense an operating status of the electronic device 100, and may then convert the measured or sensed information into electric signals. The one or more sensors 103 may include at least one of a gesture sensor, a proximity sensor, a grip sensor, a gyro sensor, an acceleration sensor, a geomagnetic sensor, an atmospheric pressure sensor, a temperature/humidity sensor, a hall sensor, an RGB (Red, Green, Blue) sensor, an illuminance sensor, a biometric sensor, a UV (Ultra-Violet) sensor, and a stylus detector. According to one embodiment, the one or more sensors 103 may be disposed on at least one of the top face 100S1, the side face 100S2, and the bottom face 100S3, or may be disposed inside the electronic device 100.

The camera 104 is a device that is capable of photographing a still image and a moving image, and may include one or more image sensors, an ISP (Image Signal Sensor) (not illustrated), or a flash LED (not illustrated). According to one embodiment, the camera 104 is disposed on the top face 100S1, but may be disposed on the side face 100S2 or the bottom face 100S3 without being limited thereto.

The key buttons 105 and 620 may include a push key or a touch key. According to one embodiment, the key buttons 105 and 620 may include a key configured to adjust volume or a key configured to turn ON/OFF power. According to one embodiment, one key button 105 may be disposed on the top face 100S1. Another key button 620 may be disposed on the side face 100S2. Although not illustrated, the buttons may be disposed on the bottom face 100S3.

The external port 106 may be used as a port to be connected with an HDMI (High-Definition Multimedia Interface), a USB (Universal Serial Bus), a projector, or a D-sub (D-subminiature) cable, or may be used as a charging port. According to one embodiment, the external port 106 is disposed on the side face 100S2, but may be disposed on the bottom face 100S3 without being limited thereto.

The microphone 107 may convert sound into an electric signal. According to one embodiment, the microphone 107 is disposed on the top face 100S1, but may be disposed on the side face 100S2 or the bottom face 100S3 without being limited thereto.

The jack 108 may be configured to electrically connect, for example, a plug of an earphone, or an ear set thereto. The jack 108 may be concealed by a cover when it is not used.

The antenna 109 (e.g., a DMB (Digital Multimedia Broadcasting) antenna) may be taken out to the outside of the electronic device 100 to extend.

The stylus 50 may be taken out to the outside of the electronic device 100. The one or more sensors 103 (e.g., an acceleration sensor or a stylus detector) may sense the attachment/detachment of the stylus 50. The pen sensor (e.g., a digitizer) may read a change in electric field when the stylus 50 comes closer thereto.

Figure 2A:
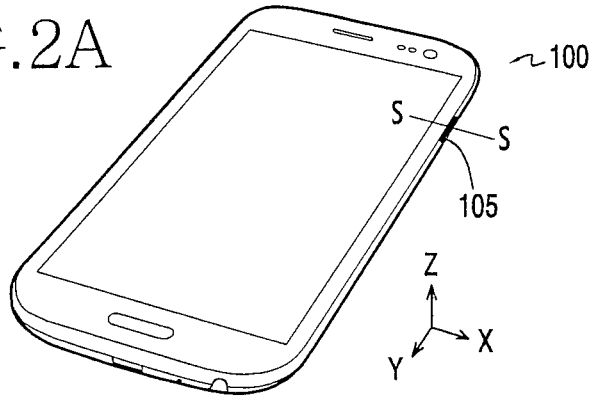
FIG. 2A, FIG. 2B and FIG. 2C include partial cross-sectional views taken along line S-S of the electronic device according to one embodiment of the present disclosure.
Figure 2B:
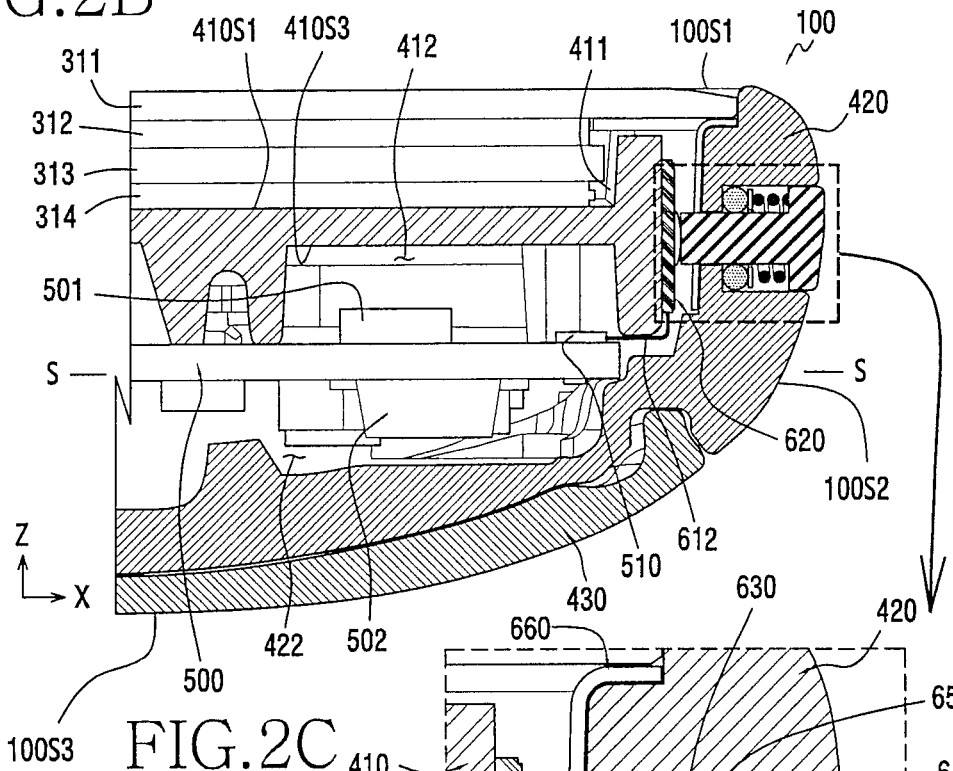
Figure 2C:
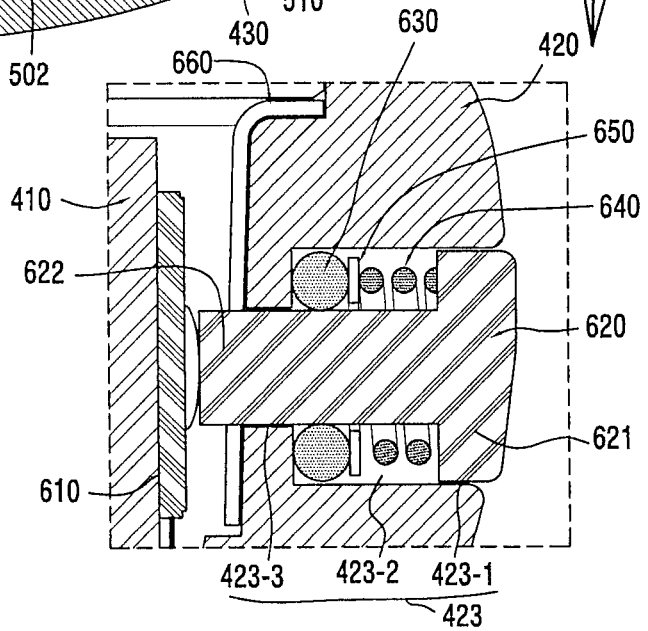

FIG. 2B is a partial cross-sectional view taken along line S-S of the electronic device, shown in FIG. 2A, according to various embodiments of the present disclosure. The S-S portion may be a portion in which the key button 105 (e.g., a power key button) of the electronic device 100 may be disposed. FIG. 2C is a magnified view of the indicated portion of FIG. 2B.

Referring to FIG. 2B, the electronic device 100 may include a window 311, a touch panel 312, a display panel 313, a digitizer 314, a bracket 410, a rear case 420, a battery cover 430, a main circuit board 500, a push switch (push button) 610, a key button 620, a sealing member 630, an elastic member 640, a washer 650, and a separation prevention member 660.

The window 311 may be disposed on the touch panel 312, and may be transparent. An image from the display panel 313 may appear through the window 311.

The touch panel 312 may be disposed below the window 311, and may receive a touch input. The touch panel 312 may be implemented as at least one of, for example, a capacitive type, a pressure-sensitive type, an infrared type, and an ultrasonic type. The main circuit board 500 may sense a touch input using the touch panel 312.

The display panel 313 may be disposed below the touch panel 312. The display panel 313 may display a signal transmitted from the main circuit board 500 as an image. The display panel 313 may be a liquid crystal display (LCD), or an active matrix organic light emitting diode (AM-OLED). According to one embodiment, the display panel 313 may be implemented to be flexible. The display panel 313 may be configured as a single module with the touch panel 312. The display panel 313 may be configured as a single module (e.g., a touch screen) with the window 311 and the touch panel 312.

The digitizer 314 (e.g., a pen sensor) is disposed below the display panel 313, and may receive an input made by the stylus 50. The digitizer 314 may be implemented as at least one of a capacitive type, a pressure-sensitive type, an infrared type, and an ultrasonic type to be equal or similar to the type of receiving a user's touch input, or may be implemented by using a separate recognition sheet. The method of using the separate recognition sheet may be a method of using an EMR (Electro-Magnetic Resonance) type.

The bracket 410 may be a mounting plate that is configured to mount a plurality of electronic components thereon. The bracket 410 may be a frame configured to fixedly support a plurality of electronic components (e.g., a processor, a memory, an SIM card, an audio codec, a speaker, a receiver, a microphone, a camera module, an indicator, a motor, a power management module, a battery, a communication module, a user input module, a display module, an interface, and a sensor module). The bracket 410 may include a first face 410S1 formed on the top face thereof and a second face 410S3 formed on the bottom face thereof. The first face 410S1 and the second face 410S3 of the bracket 410 may serve as mounting faces that are configured to mount electronic components thereon. The first face 410S1 and/or the second face 410S3 of the bracket 410 may include a flat face or a curved face. The first face 410S1 of the bracket 410 may include a shape, on which the window 311, the touch panel 312, the display panel 313, and the digitizer 314 may be seated. The second face 410S3 of the bracket 410 may include a shape, on which the main circuit board 500 may be seated. Alternatively, the first face 410S1 and/or the second face 410S3 of the bracket 410 may include a shape on which other various components may be seated. For example, the bracket 410 may include a recess 411 on the top thereof, and the window 311, the touch panel 312, the display panel 313, and the digitizer 314 may be seated in the recess 411. The bracket 410 may include a recess 412 that may accommodate upwardly protruding electronic components 501 of the main circuit board 500. The bracket 410 may be configured to seat an electronic component thereon that includes a PCB (Printed Circuit Board). The bracket 410 may be configured to seat electronic components thereon (e.g., a push switch, a sensor, a speaker, a microphone, and a camera) that are connected to the main circuit board 500 via an electric connection means (e.g., a cable or a FPCB (Flexible Printed Circuit Board)). The bracket 410 may be formed of a metallic or non-metallic material. The bracket 410 may include a metal portion (e.g., a metal coating) that may be electrically connected to a ground of the main circuit board 500.

The rear case 420 may be assembled (e.g., fastened by snap-fit or a bolt) to the bracket 410. One face of the rear case 420 may be included in the side face 100S2 of the electronic device 100. According to various embodiments, the rear case 420 may exist integrally with the battery cover 430, rather than existing as a piece that is separate from the battery cover 430. The rear case 420 may conceal a plurality of components fixed to the bracket 410. The rear case 420 may conceal at least a portion of the main circuit board 500 fixed to the bracket 410. The bracket 410, the rear case 420, and the main circuit board 500 may be assembled together in a fastening manner using a bolt. The rear case 420 may include a recess 422 that may accommodate downwardly protruding electronic components 502 of the main circuit board 500. When the bracket 410, the rear case 420, and the battery cover 430 are all assembled to each other, the exposed faces thereof at least partially form the outer face of the electronic device 100.

The battery cover 430 may be coupled to the rear case 420 so as to form the bottom face 100S3 of the electronic device 100. The battery cover 430 may include a plurality of hooks (not illustrated) on the rim thereof to be fastened to a plurality of hook engagement recesses of the rear case 420.

The main circuit board 500 (e.g., a main board or a mother board) may include a board on which a basic circuit and a plurality of electronic components are mounted. The main circuit board 500 may set an execution environment of the electronic device 100, maintain the information of the electronic device 100, allow the electronic device 100 to be stably driven, and ensure a smooth data input, output, or exchange of all the devices of the electronic device 100. The main circuit board 500 may be coupled to the bracket 410 using a fastening means, such as a bolt.

The rear case 420 may include an opening 423. According to one embodiment, the opening 423 may be arranged in the side face 100S2 of the electronic device 100. The opening 423 may include a first passage 423-1, a second passage 423-2, and a third passage 423-3. The first passage 423-1 may communicate with the outside. The second passage 423-2 makes the first passage 423-1 and the third passage 423-3 communicate with each other. The third passage 423-3 makes the second passage 423-2 communicate with the inside of the electronic device 100. Each of the second passage 423-2 and the third passage 423-3 may have a cylindrical shape. The third passage 423-3 may have a width that is narrower than the second passage 423-2.

The push switch 610 may be electrically connected to a connector 510 of the main circuit board 500. The push switch 610 may include an FPCB (Flexible Printed Circuit Board) 612, on which a connector (e.g., a female connector) is mounted, and the connector may be connected to the connector 510 of the main circuit board 500. According to one embodiment, the push switch 610 (e.g., a dome switch) may be, but not limitedly, fixed to the side face of the bracket 410.

The key button 620 may be movably inserted into the opening 423 of the rear case 420. According to one embodiment, the key button 620 may include a head 621 and an extension 622. The head 621 is a portion to be operated by a user may be exposed to the outside, and may be moved while being guided by the first passage 423-1 of the opening 423. The extension 622 may extend from the head 621 through the second passage 423-2 and the third passage 423-3 of the opening 423, and may abut against the push switch 610. The extension 622 may be attached to the push switch 610. The extension 622 may be moved while being guided by the third passage 423-3. The outer face of the extension 622 and the inner face of the third passage 423-3 may be in slidable contact with each other. The extension 622 may have a substantially cylindrical shape. A lubricant material (e.g., grease) may be interposed (e.g., coated)

between the inner face of the third passage 423-3 of the opening 423 and the outer face of the extension 622 of the key button 620. The lubricant material may block the infiltration of foreign matter (e.g., water or dust) into the inside of the electronic device 100 through a gap between the inner face of the third passage 423-3 of the opening 423 and the outer face of the extension 622 of the key button 620. The extension 622 may be anodized.

The sealing member 630 may be disposed in a space that is not occupied by the extension 622 of the key button 630 in the second passage 423-2 of the opening 423 of the rear case 420. The sealing member 630 may be disposed to be in slidable contact with the outer face of the extension 622 of the key button 620. The sealing member 630 may block communication between the internal space of the electronic device 100 and the external space of the electronic device 100 through the gap between the inner face of the third passage 423-3 of the opening 423 of the rear case 420 and the outer face of the extension 622 of the key button 620. Due to the sealing member 630, foreign matter (e.g., water or dust) cannot infiltrate into the inside of the electronic device 100 from the outside. According to one embodiment, the sealing member 630 may include an O-ring that is penetrated by the extension 622 of the key button 620.

An elastic member 640 may be interposed between the sealing member 630 and the head 621 of the key button 620 within the opening 423. The elastic member may press the sealing member 630 toward the third passage 423-3 of the opening 423 while being supported by the head 621 of the key button 620. Due to the elastic member 640, the sealing member 630 may more closely block the communication through the gap between the inner face of the third passage 423-3 of the rear case 420 and the outer face of the extension 622 of the key button 620. Due to the elastic member 640, the sealing member 630 may be in close contact with the outer face of the extension 622 of the key button 620. Due to the elastic member 640, the sealing member 630 may be in close contact with the side wall of the opening 423 which interconnects the second passage 423-2 and the third passage 423-3. The sealing member 630 may be elastically deformed by the elastic member 640 to be in close contact with a contact face. The elastic member 640 may be a compression spring or an O-ring that is penetrated by the extension 622 of the key button 620.

A washer 650 may be interposed between the sealing member 630 and the elastic member 640 within the opening 423. The washer 650 may have an annular shape, and the extension 622 of the key button 620 may be inserted into the hollow portion of the washer 650. The washer 650 may serve to press the sealing member 630 by distributing the elastic force of the elastic member 640 and/or the pushing force of the key button 620.

The separation prevention member 660 may be fixed to the inner face of the rear case 420 so as to prevent the key button 620 from being separated from the rear case 420. The key button 620 cannot be separated to the outside by the separation prevention member 660 even if it is pressed outwardly by the elastic member 640.

Figure 3:
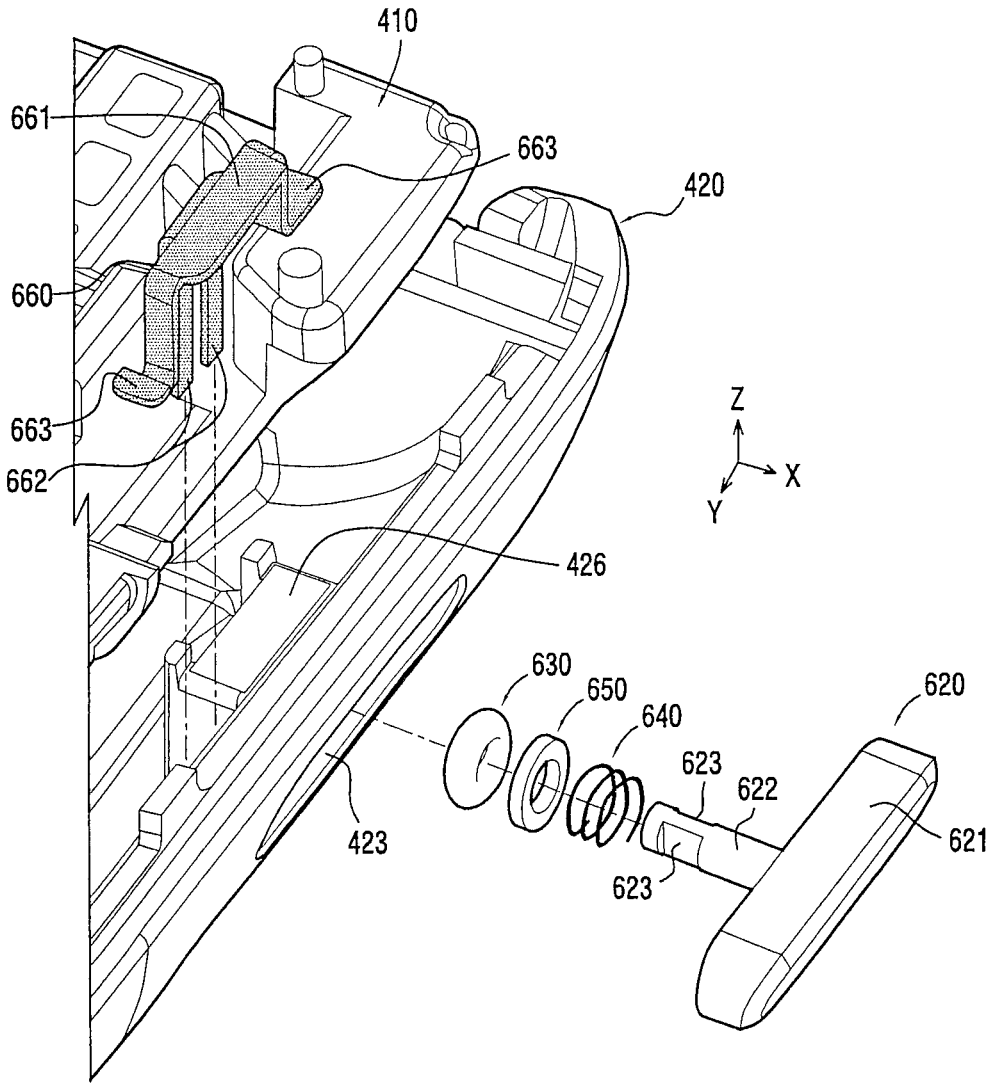
FIGS. 3 and 4 are exploded perspective views of a key button assembly according to one embodiment of the present disclosure.
Figure 4:
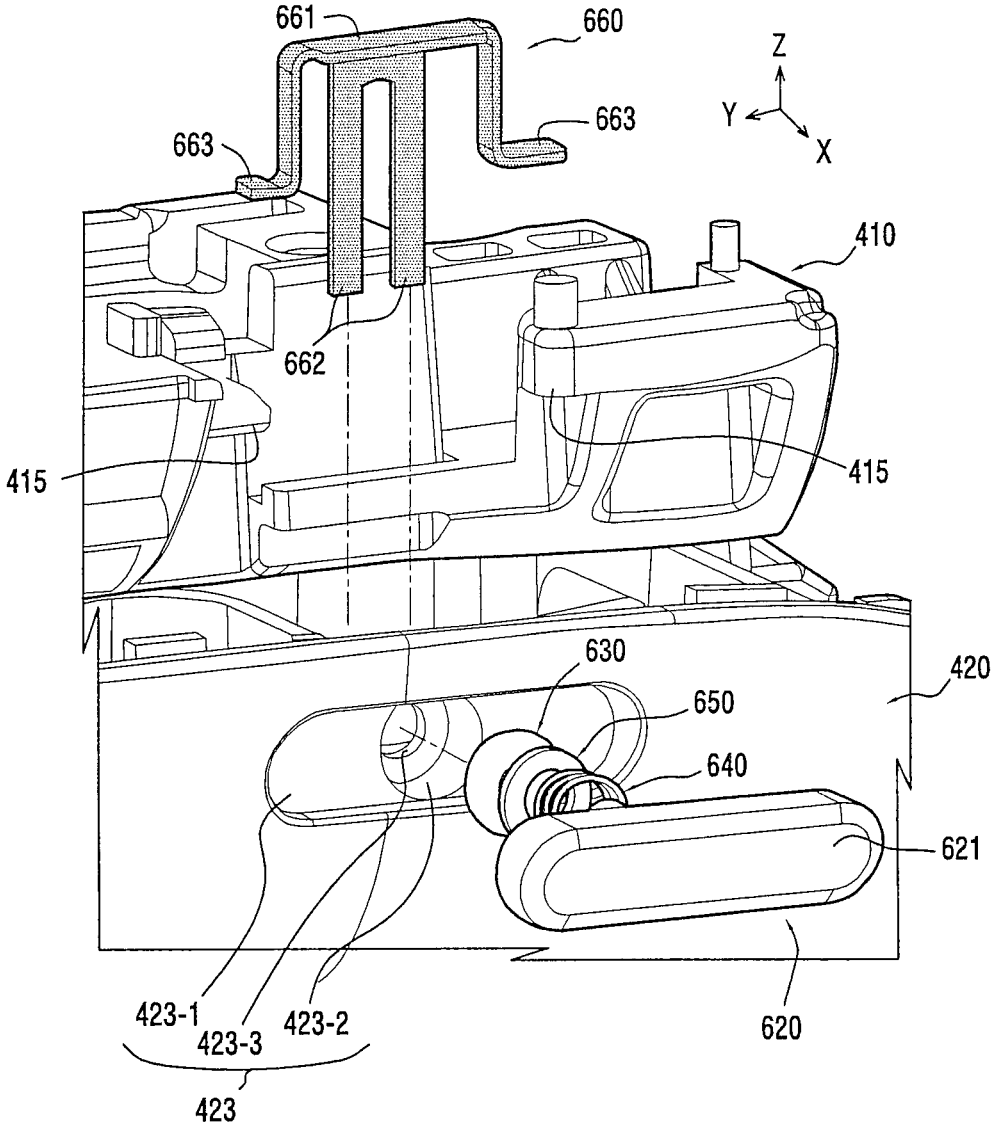

FIGS. 3 and 4 are exploded perspective views of a key button assembly according to one embodiment of the present disclosure.

Figure 11:
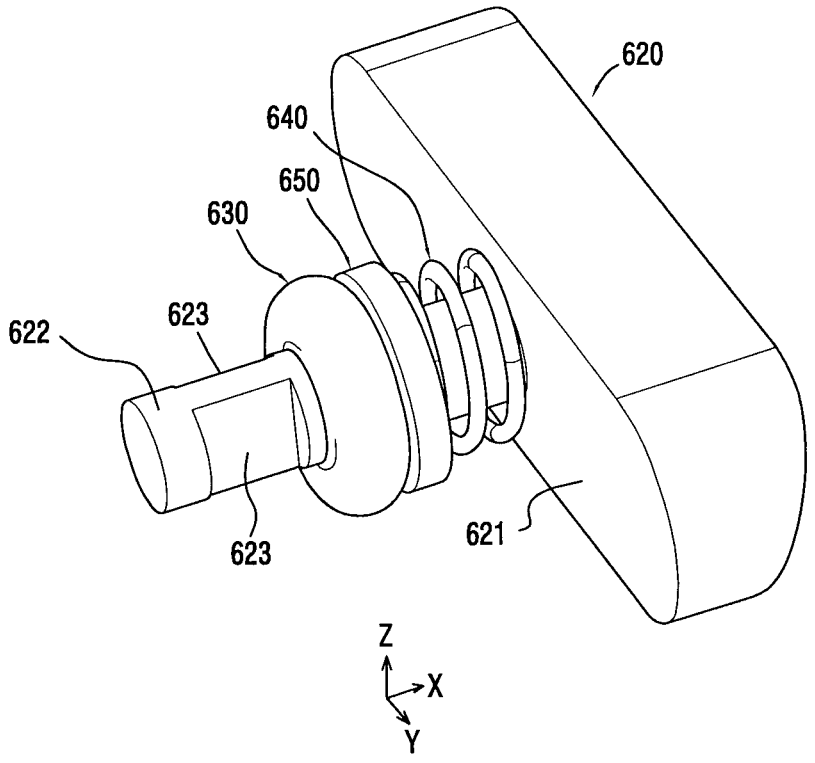
FIG. 11 is a view illustrating a sealing member, a washer, an elastic member, and a key button, according to one embodiment of the present disclosure, in an assembled state.
Figure 12:
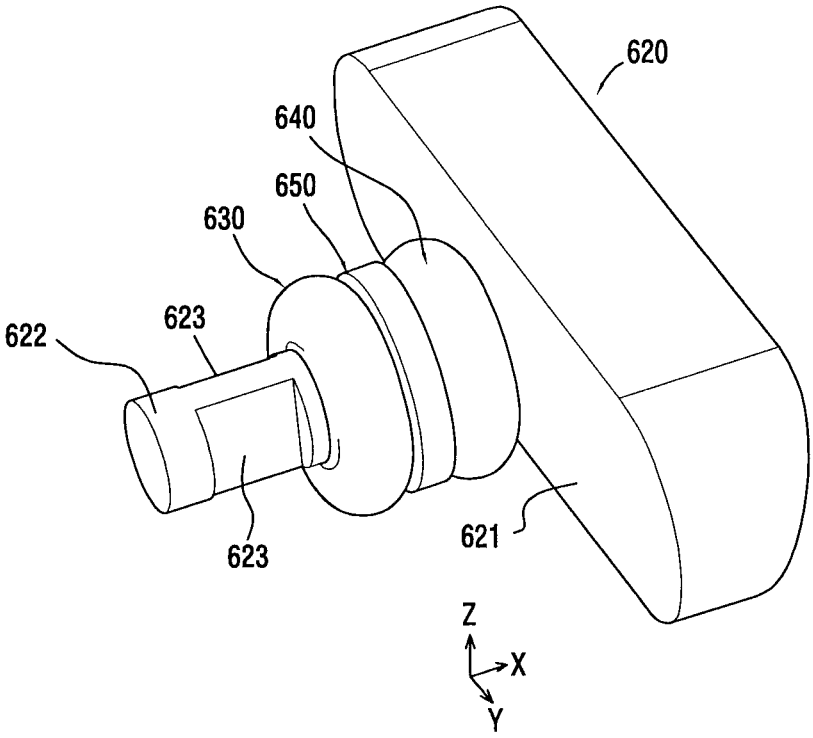
FIG. 12 is a view illustrating a sealing member, a washer, an elastic member, and a key button, according to another embodiment of the present disclosure, in an assembled state.

Referring to FIGS. 3 and 4, the sealing member 630 (e.g., an O-ring), the washer 650, and the elastic member 640 (e.g., a compression spring) may be fitted on the extension 622 of the key button 620, and may be inserted into the opening 423 of the rear case 420. FIG. 11 illustrates the sealing member 630, the washer 650, the elastic member 640, and the key button 620, according to one embodiment of the present disclosure, in an assembled state. Referring to FIG. 11, the sealing member 630 may be an O-ring, and the elastic member 640 may be a compression spring. The compression spring 640 may press the O-ring 630 via the washer 650 while being supported by the head 621 of the key button 620. FIG. 12 illustrates the sealing member 630, the washer 650, the elastic member 640, and the key button 620, according to another embodiment of the present disclosure, in an assembled state. Referring to FIG. 12, each of the sealing member 630 and the elastic member 640 may be an O-ring. The O-ring to be used as the sealing member 630 and the O-ring to be used as the elastic member 640 may have the same physical properties (e.g., an elastic repulsive force and a material) or different physical properties. The O-ring to be used as the sealing member 630 and the O-ring to be used as the elastic member 640 may have the same size or different sizes. The O-ring to be used as the elastic member 640 may press the O-ring to be used as the sealing member 630 via the washer 650 while being supported by the head 621 of the key button 620.

The sealing member 630, the washer 650, and the elastic member 640 cannot penetrate the relatively narrow third passage 423-3 of the opening 423. In contrast, the extension 622 of the key button 620 may abut against a push switch (not illustrated) fixed to the bracket 410 after passing through the third passage 423-3 of the opening 423.

The extension 622 of the key button 620 may include at least one recess 623 that is formed along the moving direction of the key button 620. According to one embodiment, there may be provided a pair of recesses 623 that are formed on opposite faces, respectively. The rear case 420 may include a seating portion 426 on which the separation prevention member 660 may be seated.

The separation prevention member 660 may include a fixing portion 661, a first extension 662, and a second extension 663. The fixing portion 661 of the separation prevention member 660 may be fixed to the seating portion 426 of the rear case 420 through welding or by using an adhesive means, such as a double-sided tape. The first extension 662 of the separation prevention member 660 may have a bifurcating shape that extends from the fixing portion 661, and may be inserted into a pair of recesses 623 formed on the extension 622 of the key button 620. The key button 620 cannot be separated to the outside by the first extension 662 of the separation prevention member 660 even if it is pressed outwardly by the elastic member 640. When the key button 620 moves, the first extension 662 of the separation prevention member 660 may move in the recesses 623 of the extension 622 of the key button 620. The second extension 663 of the separation prevention member 660 may extend from the fixing portion 661 and may include locking pieces that are fastened to locking steps 415 of the bracket 410. The second extension 663 of the separation prevention member 660 may include a pair of locking pieces that are disposed to be opposite to each other. The locking pieces of the second extension 663 may prevent the separation prevention member 660 from being separated from the rear case 420.

Figure 5:
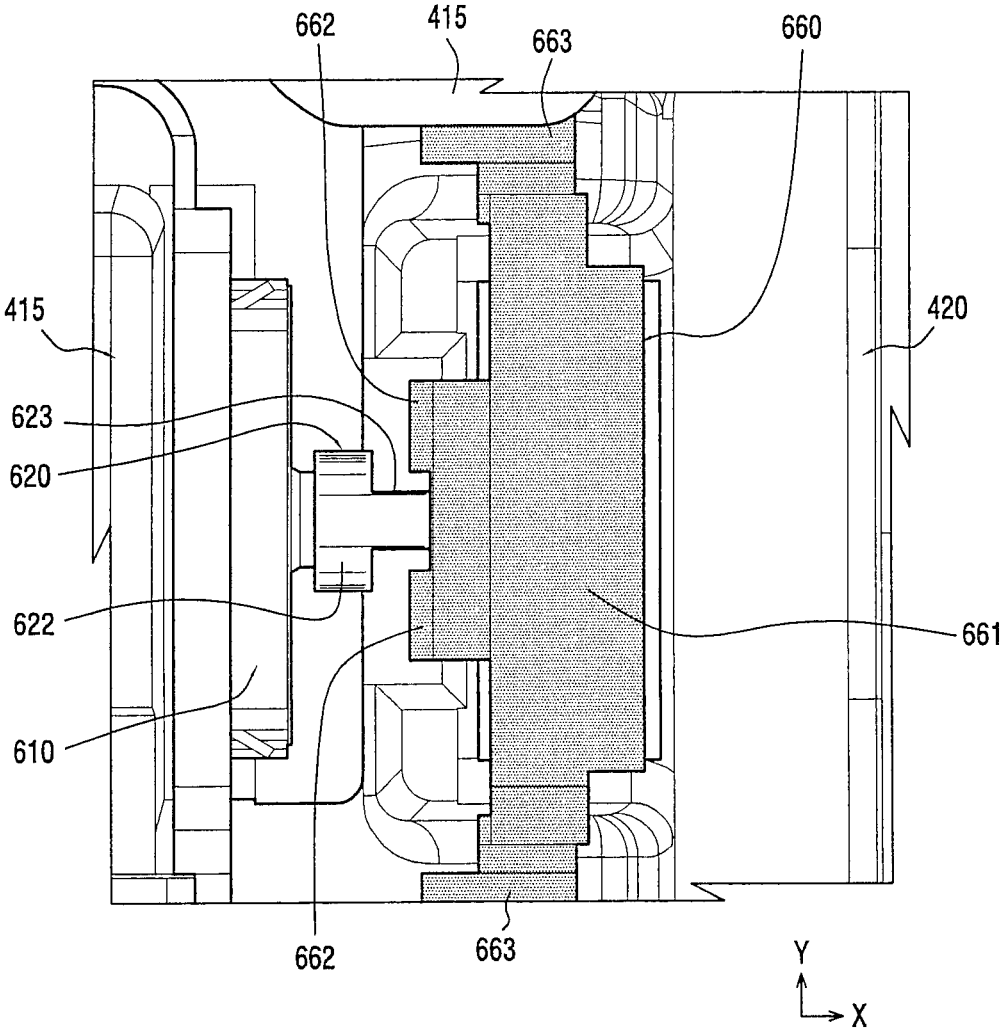
FIG. 5 is a plan view of the key button assembly according to one embodiment of the present disclosure.

FIG. 5 is a plan view of a key button assembly according to an embodiment of the present disclosure.

Referring to FIG. 5, the extension 622 of the key button 620 may be inserted into the inner space of the rear case 420 and may abut against a push switch 610 fixed to the bracket 410. The separation prevention member 660 may be fixed to the inside of the rear case 420 using the fixing portion 661 and the second extension 663. The first extension 662 of the separation prevention member 660 may be inserted into the recesses 623 of the extension 622 of the key button 620.

Figure 6:
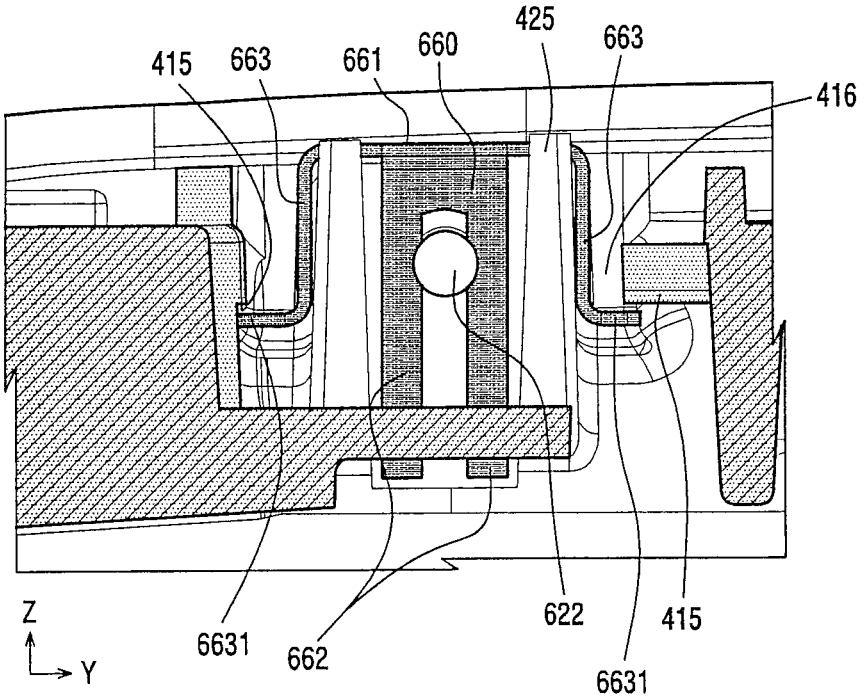
FIG. 6 is a partial cross-sectional view of the key button assembly according to one embodiment of the present disclosure.

FIG. 6 is a partial cross-sectional view of the key button assembly according to one embodiment of the present disclosure.

Referring to FIG. 6, the rear case 420 may include a structure 425 to mount the separation prevention member 660 thereon. The first extension 662 of the separation prevention member 660 may extend from the fixing portion 661 in the bottom direction of the rear case 420 (in the Z-axis direction), and may be inserted into a recess (not illustrated) of the extension 622 of the key button 620. The second extension 663 of the separation prevention member 660 may extend from the fixing portion 661 in the bottom direction of the rear case 420 (in the Z-axis direction), and the end 6631 of the second extension 663 may interact with a locking step 415, which is provided on the bracket 410 coupled to the rear case 420, in the form of a locking piece. For example, the locking piece 6631 of the second extension 663 of the separation prevention member 660 penetrates a through-hole 416 of the bracket 410, and is blocked by the locking step 415 of the bracket 410 from moving upward (in the Z-axis direction)

Figure 7:
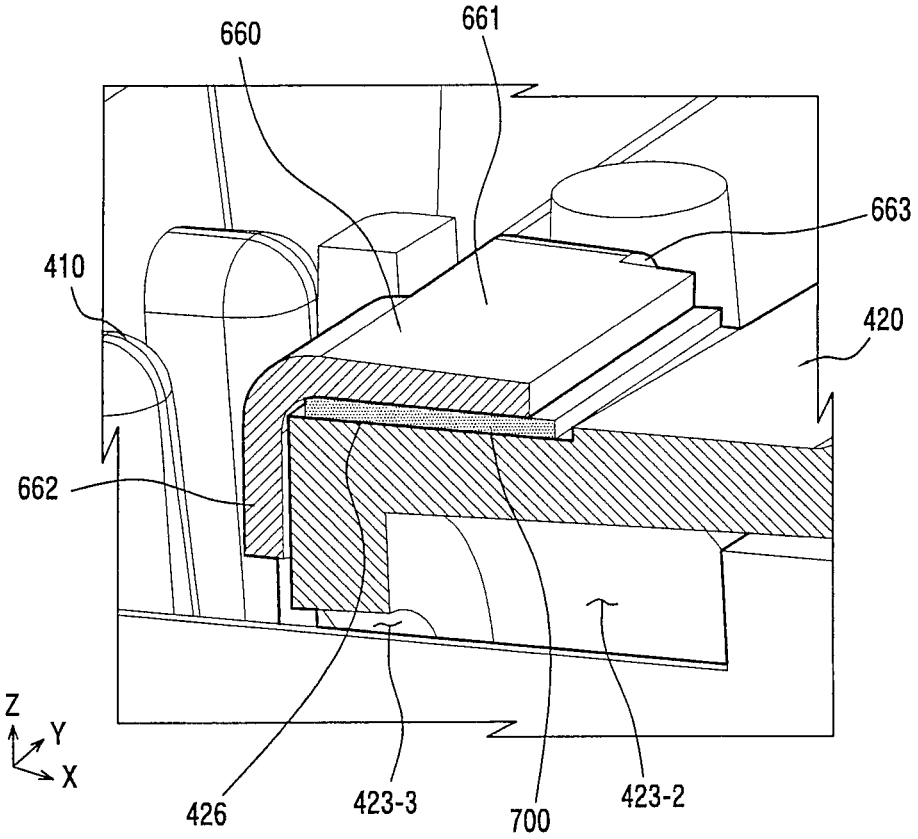
FIG. 7 is a partial cross-sectional view of the key button assembly according to one embodiment of the present disclosure.

FIG. 7 is a partial cross-sectional view of a key button assembly according to one embodiment of the present disclosure.

Referring to FIG. 7, the fixing portion 661 of the separation prevention member 660 may be fixed to the seating portion 426 of the rear case 420 through an adhesive means 426 (e.g., a double-sided tape).

Figure 8:
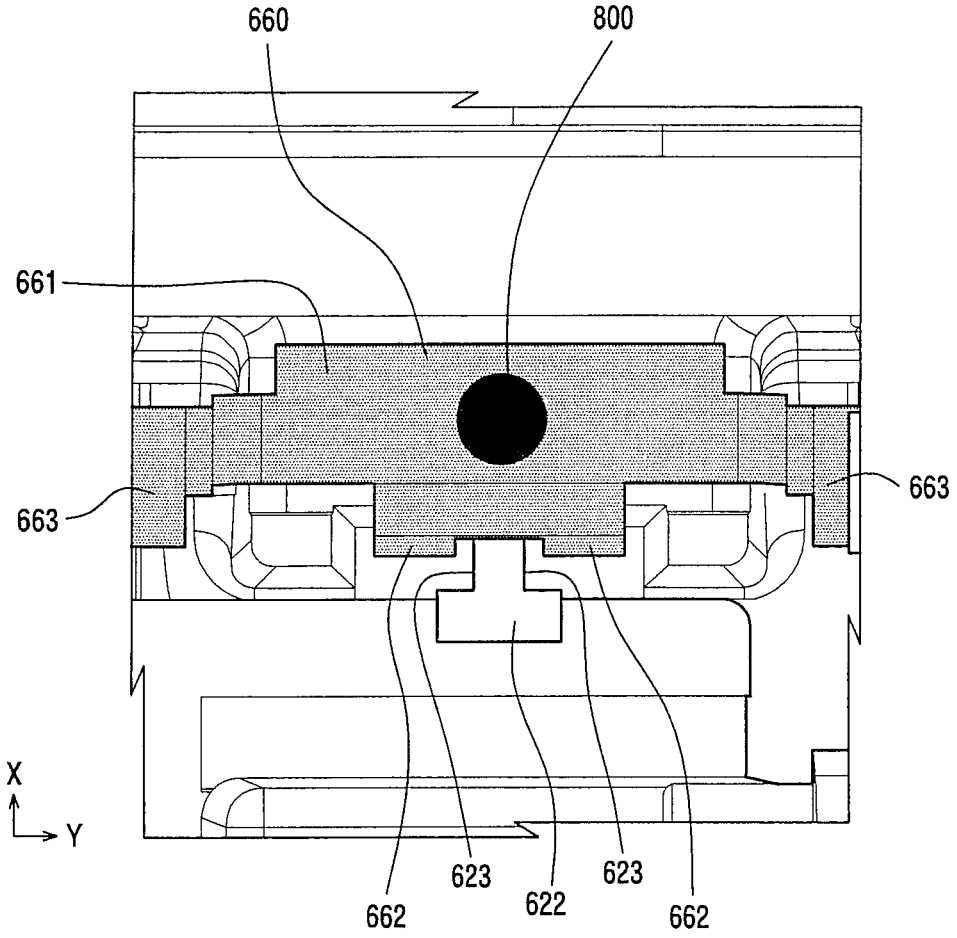
FIG. 8 is a plan view of a key button assembly according to another embodiment of the present disclosure.

FIG. 8 is a plan view of a key button assembly according to another embodiment of the present disclosure.

Referring to FIG. 8, the fixing portion 661 of the separation prevention member 660 may be fixed to the seating portion 426 of the rear case 420 through a welding process (e.g., heat welding or ultrasonic welding) (800). For example, the fixing portion 661 of the separation prevention member 660 may include a through-hole (not illustrated), and a protrusion (not illustrated), which is provided on the seating portion 426 of the rear case 420, may penetrate the through-hole of the fixing portion 661 of the separation prevention member 660 and may welded thereto (800).

In addition, although not illustrated, according to another embodiment, the fixing portion 661 of the separation prevention member 660 may also be fixed to the seating portion 426 of the rear case 420 using bolt fastening.

Figure 9:
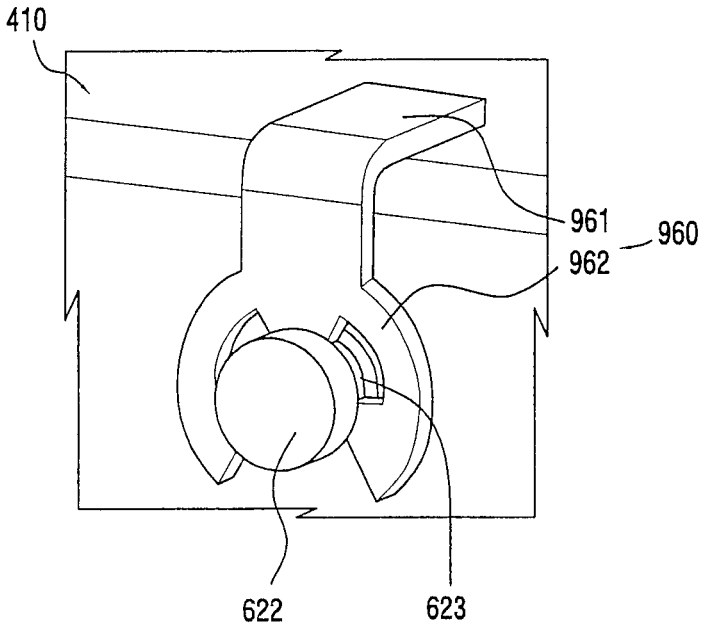
FIG. 9 is a view illustrating a separation prevention member according to another embodiment of the present disclosure.

FIG. 9 is a view illustrating a separation prevention member according to another embodiment of the present disclosure.

Referring to FIG. 9, the separation prevention member 960 may include a fixing portion 961 and an E-ring 962. The fixing portion 961 may extend from the E-ring 962 and may be fixed to the rear case 420. The E-ring 962 may be inserted into the recesses 623 formed on the extension 622 of the key button 620.

Figure 10:
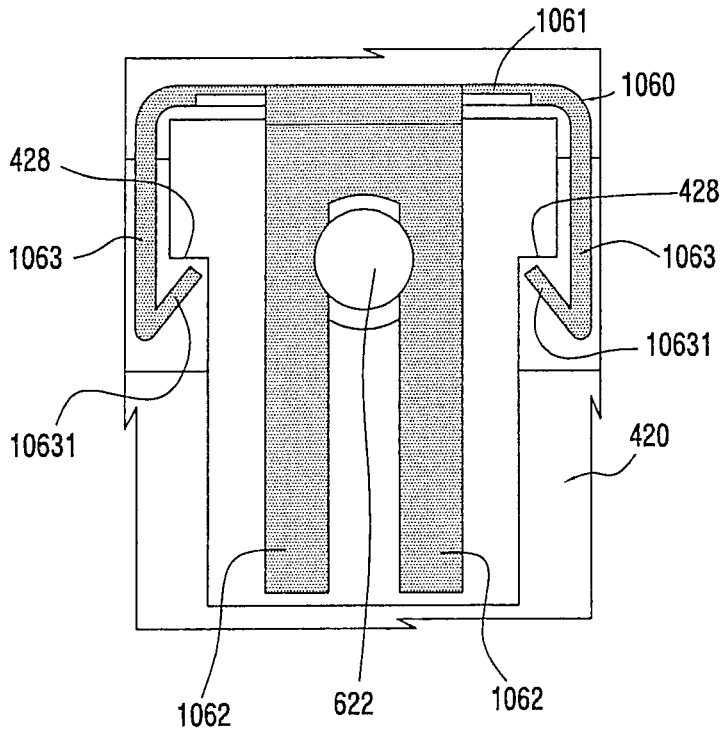
FIG. 10 is a view illustrating a separation prevention member according to another embodiment of the present disclosure.

FIG. 10 is a view illustrating a separation prevention member according to another embodiment of the present disclosure.

Referring to FIG. 10, the separation prevention member 1060 may include a seating portion 1061, a first extension 1062, and a second extension 1063. The seating portion 1061 of the separation prevention member 1060 may be seated on the seating portion (recess) (not illustrated) of the rear case 420. The first extension 1062 of the separation prevention member 1060 may have a bifurcating shape that extends from the fixing portion 1061, and may be inserted into a pair of recesses (not illustrated) formed on the extension 622 of the key button 620. The second extension 1063 of the separation prevention member 1060 extends from the fixing portion 1061, and may include locking pieces 10631 that are fastened to locking steps 428 formed on the rear case 420 through a returning movement after an elastic flexural deformation. The second extension 1063 of the separation prevention member 1060 may include a pair of locking pieces 10631 that are disposed to be opposite to each other. The locking pieces 10631 of the second extension 1063 may prevent the separation prevention member 660 from being separated from the rear case 420.

According to various embodiments of the present disclosure, an electronic device 100 may include: a housing (e.g., a rear case 420) including an opening 423 formed therethrough to communicate between the inside and outside of the electronic device 100, and configured to form an external appearance of the electronic device 100; a key button 620 movably inserted into the opening 423; a sealing member 630 disposed to be in slidable contact with an outer face of the key button 620, and configured to block communication between the inside and outside of the electronic device 100 through a gap between an inner face of the opening 423 and the outer face of the key button 620; and a push switch 610 accommodated in the housing (e.g., the rear case 420) and configured to be pressed by an inward movement of the key button 620.

According to one embodiment of the present disclosure, the inner face of the opening 423 of the housing 420 and the outer face of the key button 620 may be in slidable contact with each other.

According to one embodiment of the present disclosure, the sealing member 630 may include an O-ring.

According to one embodiment of the present disclosure, the elastic member 640 may press the sealing member 630 in a direction of the opening 423 while being supported the key button 620.

According to one embodiment of the present disclosure, the elastic member 640 may include a compression spring or an O-ring that is penetrated by the key button 620.

According to one embodiment of the present disclosure, a washer 650 may be interposed between the sealing member 630 and the elastic member 640, and may be penetrated by the key button 620.

According to one embodiment of the present disclosure, the key button 620 may include a head 621 exposed to the outside and an extension 622 configured to extend from the head 621 through the opening 423 and to abut against the push switch 610.

According to one embodiment of the present disclosure, the extension 622 of the key button 620 may be anodized.

According to one embodiment of the present disclosure, the opening 423 may include a first passage 423-1 configured to communicate with the outside of the electronic device 100, and to guide a movement of the head 621 of the key button 620; a third passage 423-3 configured to communicate with the inner portion of the electronic device 100, and to guide a movement of the extension 622 of the key button 620; and a second passage 423-2 configured to make the first passage 423-1 and the third passage 423-3 communicate with each other.

According to one embodiment of the present disclosure, the sealing member 630 and the washer 650 may be disposed in the second passage 423-2.

According to one embodiment of the present disclosure, a separation prevention member 660 may be fixed to an inner face of the housing 420 and may be fastened to a recess 623 formed in a moving direction of the key button 620 so as to prevent the key button 620 from being separated from the housing 420.

According to one embodiment of the present disclosure, the separation prevention member 660 may be attached to the housing 420 through welding or by using a double-sided tape.

According to one embodiment of the present disclosure, the separation prevention member 660 may include an elastic locking piece (e.g., a second extension 1063) fastened to a least one locking step 428 formed in the housing 420.

According to one embodiment of the present disclosure, the separation prevention member 660 may include an E-ring.

According to one embodiment of the present disclosure, a lubricant material (e.g., grease) may be interposed between the opening 423 and the key button 620.

According to one embodiment of the present disclosure, the bracket 410 may be coupled to the housing 420, and the push switch 610 may be fixed to the bracket 410.

According to one embodiment of the present disclosure, the bracket 410 may include a top face, a bottom face, and a side face, and the push switch 610 may be fixed to the side face of the bracket 410.

According to one embodiment of the present disclosure, a PCB (Printed Circuit Board) (e.g., a main circuit board 500) may be fixed to the bracket 410 and may be electrically connected to the push switch 610.

According to one embodiment of the present disclosure, a display 313 may be fixed to the bracket 410 and may be electrically connected to the PCB (e.g., the main circuit board 500).

According to one embodiment of the present disclosure, the push switch 610 may include a dome switch.

Although specific exemplary embodiments have been described in the detailed description of the present disclosure, various change and modifications may be made without departing from the spirit and scope of the present disclosure. Therefore, the scope of the present disclosure should not be defined as being limited to the embodiments, but should be defined by the appended claims and equivalents thereof.

The invention claimed is:

1. An electronic device comprising:
a housing including a through hole;
a key button including a first extension movably inserted into the through hole;
a sealing member disposed between the through hole and the first extension; and
a separation prevention member coupled to the housing to prevent the key button from being separated from the housing, wherein the separation prevention member comprises a fixed portion fixed to an inner face of the housing and a second extension extended from the fixed portion and coupled to one or more recesses formed on a portion of the first extension of the key button, wherein, in order for the one or more recesses to receive the second extension, a width of the one or more recesses in a moving direction of the key button is larger than a thickness of the second extension.

2. The electronic device of claim 1, wherein the sealing member includes an O-ring.

3. The electronic device of claim 1, further comprising:
a push switch accommodated in the housing, and configured to be pressed due to an inward movement of the key button.

4. The electronic device of claim 1, further comprising:
a lubricant material interposed between the through hole and the first extension.

5. The electronic device of claim 1, wherein the first extension is anodized.

6. The electronic device of claim 1, wherein the separation prevention member is attached to the housing through welding or by a double-sided tape.

7. The electronic device of claim 1, wherein the separation prevention member further comprises a third extension extended from the fixed portion and fastened to one or more locking steps formed on a bracket within the housing,
wherein the bracket is disposed between a display and a printed circuit board accommodated in the housing.

8. The electronic device of claim 1, wherein, when the key button is moved, a location of the second extension in relation to the one or more recesses is changed.

9. The electronic device of claim 1, wherein the sealing member is configured to block communication between inside and outside of the electronic device through a gap between an inner face of the through hole and an outer face of the first extension.

10. The electronic device of claim 9, wherein the inner face of the through hole and the outer face of the first extension are in slidable contact with each other.

11. The electronic device of claim 1, wherein the key button includes a head for a user operation from which the first extension is extended, and
further comprising:
an elastic member disposed within the through hole between the sealing member and the head of the key button.

12. The electronic device of claim 11, wherein the elastic member includes a compression spring or an O-ring that is penetrated by the first extension.

13. The electronic device of claim 11, further comprising:
a washer disposed between the sealing member and the elastic member and configured to be penetrated by the first extension.

14. The electronic device of claim 1, wherein the through hole comprises a first passage, a third passage, and a second passage between the first passage and the third passage.

15. The electronic device of claim 14, wherein the key button includes a head for a user operation from which the first extension is extended, and
wherein the head of the key button is configured to be disposed within the first passage and the first extension of the key button is configured to pass through the second passage and the third passage.

16. The electronic device of claim 15, wherein the sealing member is disposed within the second passage between an inner face of the second passage and an outer face of the first extension.

17. The electronic device of claim 15, wherein the third passage is narrower than the second passage to prevent the sealing member from moving into the third passage.

18. The electronic device of claim 15, wherein the separation prevention member comprises an E-ring coupled to a portion of the first extension that protrudes out of the third passage.

19. The electronic device of claim 15, wherein a side wall interconnecting inner surfaces of the second and third passages prevents the sealing member from moving into the third passage.

20. The electronic device of claim 15, wherein the second passage and the third passage are cylindrical.

* * * * *